US005201665A

United States Patent [19]

McCardell, Jr. et al.

[11] Patent Number: 5,201,665

[45] Date of Patent: Apr. 13, 1993

[54] CAM LOCK CONNECTOR

[75] Inventors: Willard B. McCardell, Jr., Rochester; Charles R. Schotthoefer, Bloomfield Hills, both of Mich.

[73] Assignee: Cardell Corporation, Rochester Hills, Mich.

[21] Appl. No.: 764,640

[22] Filed: Sep. 24, 1991

[51] Int. Cl.[5] ..... H01R 13/00

[52] U.S. Cl. ..... 439/157

[58] Field of Search ..... 439/152-160

[56] References Cited

U.S. PATENT DOCUMENTS

| | | | |
|---|---|---|---|
| 979,581 | 12/1910 | Smith . | |
| 1,257,051 | 2/1918 | Thomas . | |
| 1,543,755 | 6/1924 | Ebbesen . | |
| 2,058,321 | 10/1933 | Kellner . | |
| 2,577,871 | 12/1951 | Bauroth . | |
| 2,606,224 | 8/1952 | Modrey . | |
| 2,987,693 | 6/1961 | Wamsley | 439/157 |
| 3,059,206 | 10/1962 | Williams | 439/157 |
| 3,534,320 | 10/1970 | Rushing | 439/157 |
| 3,587,037 | 10/1971 | Anhalt . | |
| 3,594,698 | 6/1972 | Anhalt . | |
| 3,778,747 | 12/1973 | Curcic | 439/157 |
| 3,818,420 | 6/1974 | Barr . | |
| 4,070,081 | 1/1978 | Takahashi . | |
| 4,586,771 | 5/1986 | Kraemer et al. . | |

*Primary Examiner*—Joseph H. McGlynn

*Attorney, Agent, or Firm*—Jones, Tullar & Cooper

[57] ABSTRACT

A two-part multiterminal connector includes a terminal plug connector element and a complementary terminal socket connector element. A cam mounted on a shaft on one connector element includes a spiral camming channel which is centered on the shaft. The channel engages a cam follower mounted on the other connector element, whereby rotation of the cam about the shaft causes the cam follower to be drawn along the spiral camming channel. As the cam rotates, the cam follower is drawn closer to the shaft, causing the pin and socket terminals within the connector elements to mate. Reversal of the cam assembly disassembles the connector.

2 Claims, 2 Drawing Sheets

CAM LOCK CONNECTOR

BACKGROUND OF THE INVENTION

The present invention relates, in general, to multiterminal, cam-operated electrical connectors, and more particularly to a rotatable cam arrangement for assembling and disassembling multiterminal connectors.

With the increasing use of electrical and electronic components in a wide variety of consumer products, the provision of reliable electrical connections to and between such components has become increasingly difficult, for not only are larger numbers of components being used, but the components are becoming more complex, requiring larger numbers of wires and connectors. Even with miniaturization of the electronics, the space available in many consumer products is becoming crowded, and all of these factors combine to magnify the problem of installing, replacing, or repairing the electronic components. Typically, such components are interconnected by means of complex wiring harnesses which may incorporate large numbers of wires and cables. These harnesses usually are fashioned with standardized connectors at their ends to permit them to be connected directly to corresponding terminals on the components or to permit them to be interconnected with other wires, cables, or harnesses. Such connectors must permit easy and accurate connection of the wiring harnesses and in addition must be easily releasable to permit quick repair or replacement of electrical components, wiring harnesses, or the like. Such connectors must be not only easy to use, but must be extremely rugged so that they can withstand multiple connections and disconnections, while at the same time being capable of withstanding harsh environmental conditions.

An example of the problems encountered with the use of such connectors is found in the automotive industry where the increasing use of electronics is leading to additional and more complex electrical connections utilizing large numbers of cables and harnesses. To accommodate the demand for electronic systems, not only are more connectors needed, both for end-to-end connections between harness as and for connections between components and their interconnecting wires, but each connector must be able to incorporate larger and larger numbers of terminals. Furthermore, as the number of cables and harnesses increases, the space available for mounting these connectors becomes more limited, with the result that the dimensions of the connectors themselves must be reduced, even as the number of terminals they can accommodate must be increased.

Typically, a multiterminal connector includes a first connector plus element which incorporates a large number of terminal pins or blades and a second, complementary connector receptacle element which incorporates a large number of terminal sockets. To assemble these two connector elements, the terminal pins or blades must engage corresponding terminal sockets and be seated firmly therein so that the required electrical connections between individual wires in a wiring harness are completed. Although an individual pin or blade may require only a moderate amount of force to engage a corresponding socket, as the number of terminals increases within a connector, and/or as the size of the pins or blades and sockets decreases, and as the pins or blades and sockets become more closely spaced due to miniaturization, the force required to assemble the connector plug and receptacle terminals is multiplied many times over. As a result, assembly or disassembly of connectors with large numbers of terminals becomes a significant problem.

Similar problems are encountered when attempting to separate the two elements of a connector, for with a large number of terminals, the force required to pull them apart can be quite large. This is particularly a problem when the connector elements have been assembled for a long period of time in a harsh environment which tends to freeze the components together. In addition, where the connector is dimensionally small with a large number of terminal pins or blades and sockets packed close together, the forces required to assemble or disassemble the connector elements can be very high, making it almost impossible to manually press the parts together or pull them apart, particularly if the connector is in a location which is hard to reach.

One solution to this problem has been the provision of bolts which pass through one connector element and engage corresponding threaded brass inserts embedded in the other connector element. By tightening the bolts, the two connectors are drawn together to assemble the connector. However, although often used, such an arrangement has numerous disadvantages. For example, the bolt arrangement requires the use of a special tool such as a pneumatic wrench, and in addition requires extra manufacturing steps and extra cost to make the necessary brass inserts and to embed them in the connector housing. If the bolt is cross-threaded during assembly of the connector, the connector and its attached harness may be made unusable, thus increasing the cost of such an approach to the assembly of two-part connectors.

SUMMARY OF THE INVENTION

In accordance with the present invention, the problems of assembling and disassembling multiterminal connectors having terminal plug and terminal socket elements incorporating pins, blades, or other similarly engaging terminal elements can be overcome through the use of a cam mechanism for drawing together or moving apart the terminal plug and terminal socket elements of the connector. A multiterminal connector, as herein described, includes a two-part, or two-element, electrical connector, usually having a large number of terminals, arranged in rows, concentric circles, or other patterns, and wherein the terminals are usually packed closely together so as to incorporate a large number of electrical connections in a small area. Typically, such connectors will have 24 or more pins, blades, or other terminals, in a connector housing measuring ½ to 2 inches by 2 to 6 inches, for example. A first, or plug, element of the connector typically includes a housing having a large number of pin-type terminals located in a predetermined pattern, the terminals each having an outer end mounted in the housing and connectable to an external, corresponding wire or cable. The opposite, or inner, ends of the terminals may be in the shape of thin, elongated pins, blades, or the like, extending into the interior of the connector plug element housing. These terminals will hereinafter be referred to as pins or pin-type terminals, but it will be understood that such terminals may have a wide variety of shapes or configurations. The second connector receptacle element typically includes a housing having a large number of socket terminals, or sockets, which are complementary in shape to the terminal pins and are configured to receive the pins so as to produce a firm and reliable electrical connection. The number of pins and sockets in the two elements need not be equal, but usually are, with the socket terminals being arranged in a pattern which corresponds to that of the terminal pins so that upon assembly of the elements each pin will engage a corresponding socket. Each of the sockets mounted in the receptacle element housing is connectable at an outer end to a corresponding exterior wire or cable, and has its opposite, or inner, end facing or extending into the interior of the receptacle element housing.

In accordance with one form of the present invention, the housing forming the first, or plug element of the connector is shaped to telescopically receive the housing of the second or socket element of the connector, with guide channels being provided in the pin housing to receive corresponding guide rails formed on the socket housing. The close fit between the telescoping housing elements cooperates with the guide channels and guide rails to prevent skewing of the connector elements, thereby to ensure that the terminal pins remain aligned with their corresponding terminal sockets during assembly and disassembly. In the preferred form of the invention, the socket element housing telescopes snugly into the interior of the pin element housing, with the guide rails extending outwardly from the socket housing into the corresponding guide channels formed in the pin housing. In a first stage of assembly of the connector, the socket housing preferably moves about one-half inch into the terminal housing before the pins contact their corresponding sockets, so that the two elements are aligned before mating engagement between the pins and sockets occurs. This initial stage of assembly is relatively resistance free, since the surfaces of the guide rails and channels and the contacting inner and outer surfaces of the plug terminal housing and socket terminal housing, respectively, are relatively smooth to allow the housing elements to slide smoothly together.

The second stage of assembly occurs after the pins and sockets are brought into initial contact and begin to engage. At this point, the resistance to further motion increases significantly, making manual engagement of the terminals difficult. This second, or final stage of assembly of the two elements is accomplished by means of a locking cam which is rotatably mounted on one of the housing elements and a cam follower in the form of a locking stub mounted on the other housing element. The locking cam is brought into engagement with the stub as the terminal elements are brought together during the first stage of assembly; thereafter, in the second stage of assembly, motion of the cam in a first direction engages the stub to draw the two elements together to complete the assembly. Motion of the cam in the opposite direction forces the two elements apart to initiate disassembly of the connector elements.

Preferably, the locking cam is mounted on the outermost of the two telescoping connector elements, with the stub being mounted on the innermost element. For example, the cam may be mounted on the outer surface of a side wall of the plug connector element, with the body of the cam extending over a corresponding side wall of the socket connector element. In the preferred embodiment of the invention, an upright stub on the socket connector element side wall is aligned with a cam-entry channel which leads to a curved slot formed on a lower, or downwardly-facing, surface of the cam body, so that as the two connector elements are initially brought together for assembly of the connector, and as the socket element housing enters the plug element housing during the initial assembly stage of the connector, the stub enters the entry channel, moves along that channel, and engages the curved camming slot in the cam body. The slot forms a spiral path about the axis of rotation of the cam so that after engagement of the stub with the slot, the second stage of assembly of the connector can be produced by rotation of the cam body. Such rotation draws the stub toward the axis of rotation and thereby draws the socket terminal element firmly and smoothly along the axis of assembly of the connector to cause the pin terminal elements to matingly engage the corresponding socket terminals. In the preferred form of the invention, the axis of rotation of the cam is perpendicular to the axis of motion of the socket terminal element, and the camming slot is shaped to move the socket element about one-fourth inch to fully engage the pin and socket terminals.

The cam preferably includes a thumb lever on its upper surface to facilitate rotation of the cam body, and this lever, together with the camming slot, provides a significant mechanical advantage for the assembly of the connector, with the result that the force required to rotate the cam is considerably less than that which would be required to manually press the same elements together or pull them apart. By shaping the cam and the thumb lever so that the end of the lever travels 3 inches, for example, as the cam is rotated 180° from an open to a closed position, a 12 to 1 mechanical advantage is obtained in seating the pin terminals in their corresponding socket terminals. This means that a 100 pound connection force can be obtained by applying a little over eight pounds of force to the end of the lever. If the lever is extended to both sides of the cam, so that it is operated by the installer applying thumb and fingers against opposite ends of the lever, the 8-pound force is divided, further facilitating assembly of the connector. Thus, the cam arrangement can easily provide a significant mechanical advantage for engagement of the connector terminals.

The camming slot preferably includes a short end portion which is concentric with the cam axis of rotation so that the pressure exerted on the cam surface by the terminal elements is released after the terminal pins are fully engaged with their corresponding sockets to provide a closed, locked position for the cam and connector assembly. Disassembly of the connector elements is accomplished by reversing the rotation of the cam, moving it from its closed to its open position and forcing the stub on the socket housing away from the axis of rotation of the cam, thereby forcing the socket connector element out of the pin connector element to separate the terminals.

The location of the cam on the sidewall of the connector makes it accessible to an operator, while the mechanical advantage of the cam greatly facilitates its operation. The cam axis of rotation is centrally located between the ends of an elongated connector, so that rotation of the cam draws the connector elements rapidly and smoothly together to reliably interconnect the pin and socket terminals.

Although the connector elements are herein illustrated and described as being terminal connectors for the ends of wires and cables, it will be apparent that one or the other, or both, of these elements can be directly mounted on electrical components such as printed circuit boards for connecting wires or cables to such circuit boards or for directly interconnecting such components.

BRIEF DESCRIPTION OF THE DRAWINGS

The foregoing, and additional objects, features and advantages of the present invention will become apparent to those of skill in the art from the following detailed description of a preferred embodiment thereof, taken in conjunction with the accompanying drawings, in which.

DESCRIPTION OF PREFERRED EMBODIMENT

Figure 1:
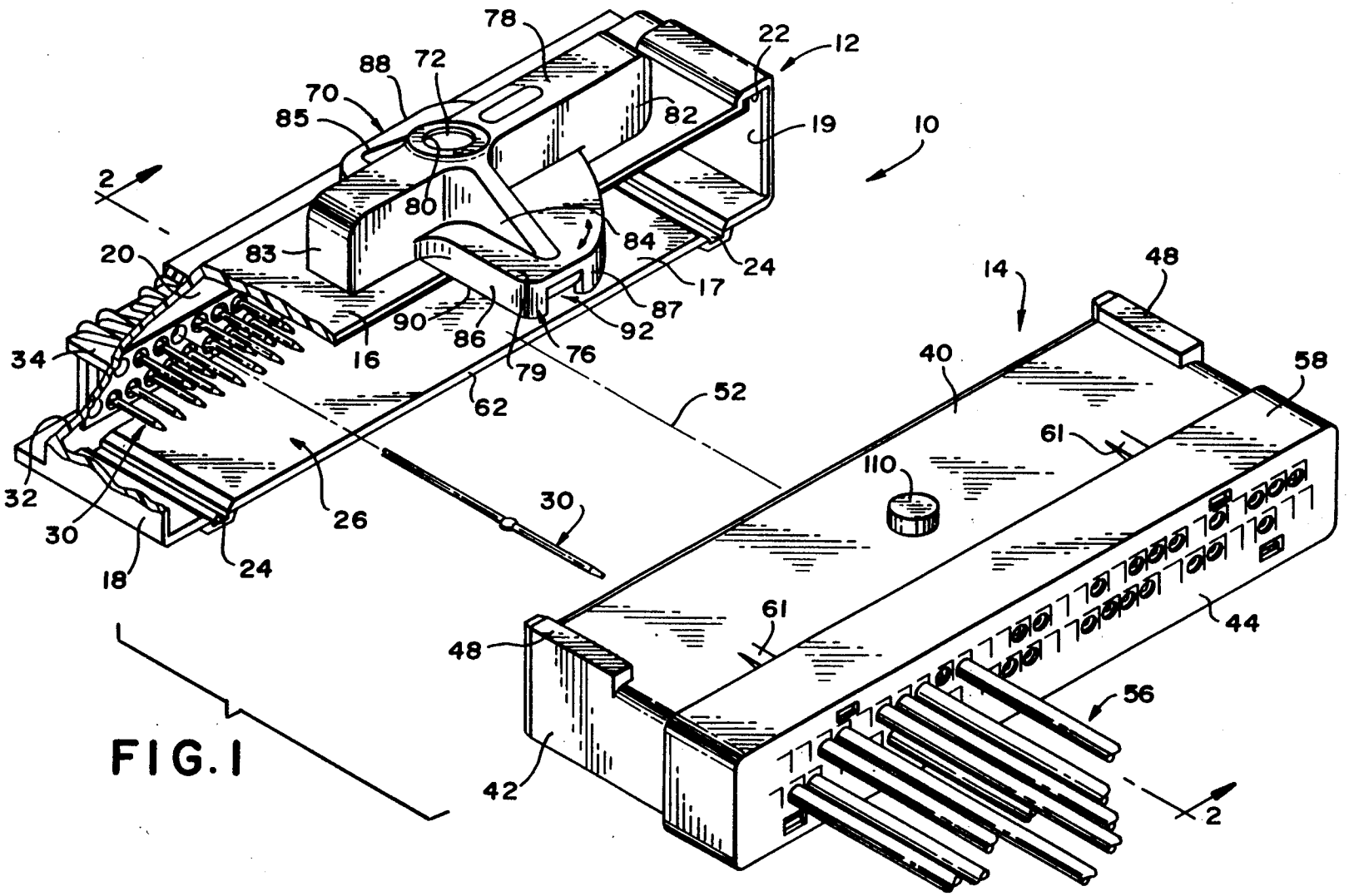
FIG. 1 is an exploded, perspective view, partially cut away, of a two-part connector with an assembly cam in accordance with the present invention.

Turning now to a more detailed consideration of a preferred form of the present invention, there is illustrated in FIG. 1 a two-part multiterminal connector 10, consisting of a plug terminal element 12 and a mating socket terminal element 14. These connector elements preferably are molded from a suitable plastic material such as a filled polyester, and may take a wide range of shapes and sizes. Typically the plug terminal element 12 will consist of a generally rectangular, elongated housing having top, bottom, left and right side walls 16 through 19, respectively, and a rear wall 20 which closes the back of the housing, leaving the opposite, or forward end open to receive the mating connector element 14. The housing of element 12 preferably includes a number of grooves or channels which serve as guides for directing the mating element 14 into the interior of element 12. For example, the top wall 16 may include a pair of spaced channels 22 which extend outwardly from the housing, the channels preferably being located at the opposite ends of the side wall 16, adjacent walls 18 and 19. Only one of the channels 22 is illustrated in FIG. 1, the other being cut away. Similarly, a pair of channels 24 may be located in spaced-apart locations on the bottom wall 17 of the housing of element 12, the channels preferably being located near, but not abutting the end walls 18 and 19. The channels 22 and 24 are parallel to the side walls 18 and 19, and serve to guide the socket terminal element 14 along a straight line as it is inserted into the interior cavity 26 of the housing which is defined by the walls 16 through 20 of element 12.

The rear wall 20 of the element 12 carries a multiplicity of electrical terminals which, as illustrated in this embodiment, are connector pin terminals of the type generally indicated at 30. These terminals are conventional, and various other terminal configurations may be used, with each terminal being mounted in and/or secured to the rear wall 20 and extending forwardly into the cavity 26 for engagement with corresponding socket terminals located in the connector element 14. The rearward ends of the terminals 30 extend through apertures in the wall 20 and are accessible from the back surface 32 of wall 20 for connection to corresponding wires 33 for example, from a wiring harness (See FIG. 2). Alternatively, the terminals may be connected to the wires before they are inserted in the wall 20. Preferably, the terminals 30 are arranged in a pattern within the housing, for example, in two staggered offset rows, as illustrated. A cover 34 is mounted against the outer surface 32 of wall 20, as by a snap-on fit, to separate the wires leading to the ends of the terminal pins 30 and to provide waterproofing for the connector. Typically, the wall 20 and the cover 34 incorporate apertures only where terminals and their connecting wires are required, and if extra apertures are present, these are closed by pegs formed on the inner surface of cover 34 to seal them. The apertures in the wall 20 may be covered by a suitable grommet 36 for further waterproofing, with the cover 34 providing strain relief for the wires to ensure that the grommet remains intact. The exact structure of the terminal pins and the manner in which they are mounted in the rear wall 20 and connected to a wiring harness or to terminals on an electrical component may vary widely and are not a part of the present invention.

Figure 2:
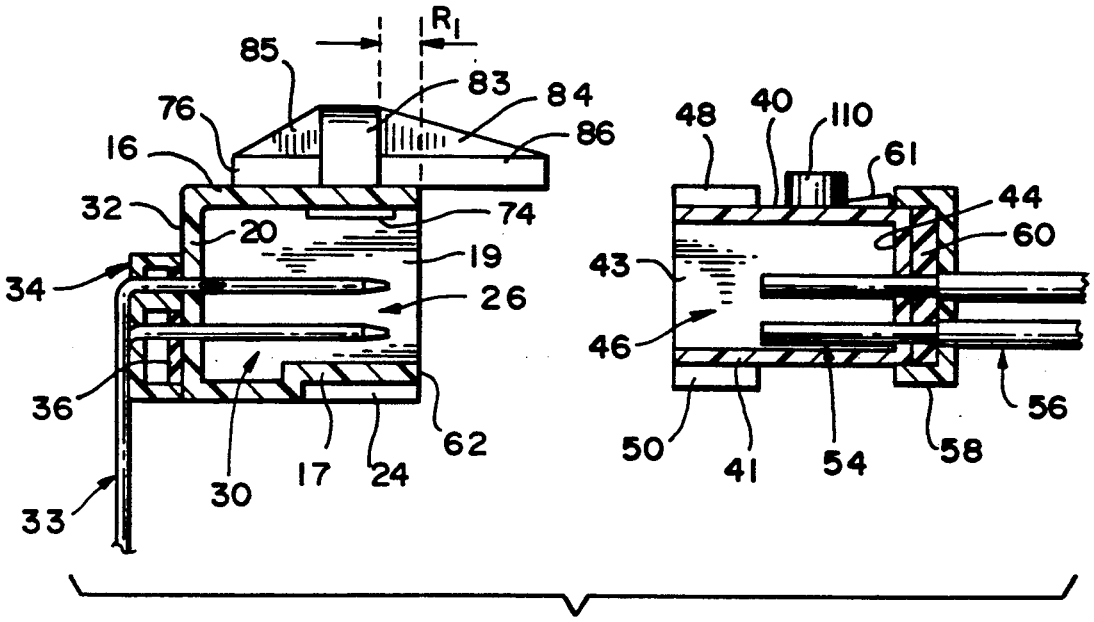
FIG. 2 is a sectional view taken along line 2—2 of FIG. 1.

Connector element 14 is complementary to element 12 and includes top, bottom, left and right hand walls 40 through 43 (see FIGS. 1 and 2) and a rear wall 44 defining a housing having a closed end and an interior cavity 46, as illustrated in FIGS. 1 and 2. The housing defined by walls 40 to 44 is complementary in shape to the opening defined by the walls of housing 12 so that element 14 can be mated with element 12 by sliding the two elements together in a telescoping fashion. The connector housings have smooth surfaces to facilitate assembly of the socket and pin elements. The top wall 40 of element 14 carries a pair of spaced guide rails 48, one located at each end of the top wall 40, which are aligned with, and are received in, the corresponding guide channels 22 formed in the top wall 16 of element 14. In similar manner, the bottom wall 41 of element 14 carries a pair of spaced guide rails 50 which are aligned with, and are received in, corresponding channels 24 in the bottom wall 17 of element 12. The guide rails 48 and 50 and the channels 22 and 24 ensure that the two connector elements 12 and 14 and the electrical terminals carried thereby will engage smoothly and will move in a direction parallel to their common axis of assembly indicated by the dotted line 52 in FIG. 1. It will be understood that the locations of the guide channels and guide rails may be varied from those illustrated in the Figures, and that, if desired, the channels can be located on element 14 and the rails on element 12.

In the preferred form of the invention, the rear wall 44 of element 14 carries a plurality of socket terminals generally indicated at 54 in FIG. 2, the socket terminals extending forwardly into the cavity 46. The terminals 54, in the illustrated embodiment, are generally tubular, elongated terminals having interior openings adapted to receive and engage corresponding terminal pins 30. The rearward ends of the socket terminals 54 (to the right, as viewed in FIG. 2) are connectable to corresponding cables or wires generally indicated at 56 in known manner and are mounted on and secured to the wall 44. The sockets 54 are arranged in a predetermined pattern within element 14; for example, in two staggered or offset rows corresponding to and aligned with the rows of terminal pins 30, as illustrated in the embodiments of FIGS. 1 and 2. As is known, the number and location of terminal pins and terminal sockets may vary. It is not necessary to provide wiring connections to each of the elements, if such connections are not needed, and it is not necessary to provide pins or sockets in every location, although corresponding terminals must be aligned. The construction and assembly of the terminal sockets 54 and wires 56 are conventional.

The rearward portion of the housing for socket element 14 may have a cover plate 58 for facilitating sealing of the socket element. This cover may secure a grommet 60 against the rear wall 44 to weatherproof the socket element 14. In such a case, the grommet may include holes aligned with the terminal apertures in wall 44 to provide access to the terminals 54. In locations where no terminals are used, the cover 58 may include inwardly extending pegs (not shown) to fill the holes in the grommet. The cover includes apertures for the wires 56 at locations corresponding to terminals 54. Element 14 also includes spaced ramps 61 on its top and bottom walls 40 and 41 for engaging the forward edge portion 62 of element 12 when the connector elements are fully assembled.

The initial stage of assembly of the elements 12 and 14 is accomplished by manually aligning the two elements and engaging the guide rails 48 and 50 with the corresponding channels 22 and 24 so that the terminal pins 30 are in alignment with corresponding socket terminals 54 and the elements are ready to be telescoped together. The elements 12 and 14 are then pressed together manually to bring the terminal pins into initial contact with the terminal sockets. As indicated above, in a typical connector, this stage may involve a telescoping movement of about one-half inch, the exact distance depending on the size of the connector. With large numbers of terminal pins and sockets engaging in a given connector structure, manually pressing the terminal elements together beyond this initial stage so as to obtain a complete engagement of the pin and socket terminals is quite difficult, for a high degree of force is required. Furthermore, with prior such connectors, even if the device could be manually assembled, disassembly of the connector became extremely difficult, for once the element 14 was inserted into the pin element 12, only the rearward edge of element 14, defined by a peripheral ridge 58, could be grasped. As a result, very little pressure could be obtained, and with a large number of terminal connections within the connector unit, disassembly was extremely difficult.

In order to facilitate full assembly of the connector 10 in the manner discussed above, and thereafter to facilitate the disengagement of the pins and terminals, a cam element is provided on one of the two elements 12 and 14 for engaging a cam follower on the other element. The cam and follower cooperate to provide a second stage of assembly of the two-part connector, motion of the cam serving to draw the pin and socket terminals from their potions of initial contact, described above for the first stage of assembly, into full mating engagement, with further motion of the cam, as in a reverse direction, serving to push the pin and socket terminals apart to disassemble the connector.

In the illustrated embodiment of FIGS. 1 and 2, the pin terminal element 12 carries a rotatable cam 70 on its top wall 16. The cam is mounted for rotation about a central shaft 72 which extends through the top wall 16 and is secured thereto, as by welding, for example, or by a suitable adhesive (not shown). The bottom of the shaft may include a head 74 which prevents the shaft from pulling through the wall 16. Alternatively, the shaft 72 can be integrally formed with element 12, as by molding from a suitable plastic material. The cam 70 includes a body portion 76 which is generally semicircular in plan view, with one end truncated in the manner illustrated in FIG. 3, and which is formed with an integral handle portion 78, which functions as a lever, on its top surface 79. The handle 78 extends across the body portion 76 and both the body and the handle are formed with a central aperture 80 through which the shaft 72 extends so that the cam rotates about shaft 72. Preferably, the top of shaft 72 includes an annular shoulder portion which engages a corresponding annular groove formed in the surface of handle 78 around aperture 78 so that the cam body will snap onto the shaft and be secured for easy rotation with respect to the connector element 12.

The handle portion 78 includes a first lever end 82 and a second lever end 83 extending in opposite directions from the shaft 72 for ease in gripping and turning the cam. Thus, the first end 82 may be considered a finger rest section and the second end 83 may be considered a thumb rest section to facilitate the operation of the device by an operator. A pair of braces 84 and 85 extend outwardly at right angles from the handle 78 in the region of shaft 72 to support and strengthen the handle. Preferably, the body portion, handle and braces forming the cam 70 are unitary and may be molded from a suitable plastic material as a single piece.

Figure 3:
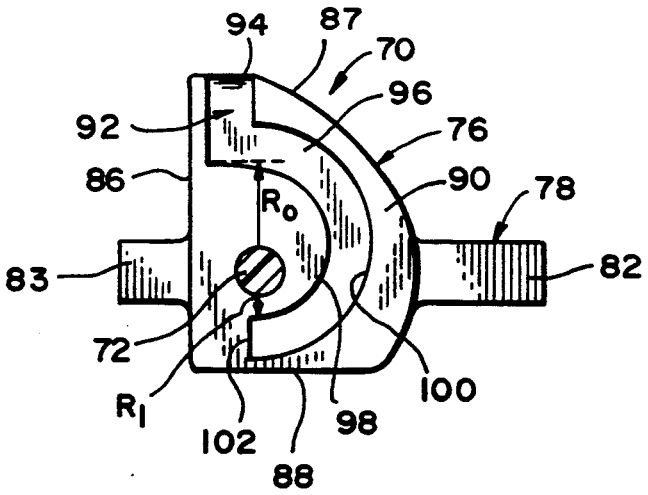
FIG. 3 is a bottom plan view of the underside of the cam element of FIGS. 1 and 2.

As shown in the bottom plan view of FIG. 3, the semicircular cam body 76 is defined by a straight edge wall 86 and a curved edge wall 87, and is truncated at one end as defined by an end wall 88. The body 76 includes a bottom surface 90 in which is formed a camming slot or channel 92 which is curved around the opening 80, and thus the shaft 72, with the side walls of the channel forming a camming surface. The channel 92 includes an entry portion 94 for receiving a cam follower (during the first stage of assembly of the connector), and includes a camming portion 96 which follows a spiral path centered around shaft 72. The camming portion 96 is at a radius $R_0$ from the shaft 72 in the region of the entry portion 94, and is at a radius $R_1$ from the shaft 72 on the opposite side of shaft 72, as best illustrated in FIG. 3. Accordingly, the radius of the path of the camming section 96 decreases substantially continuously from $R_0$ to $R_1$ in 180° around shaft 72. Channel section 96 is defined by its inner and outer walls 98 and 100 which form camming surfaces, and which are concentric throughout their length so that both of the walls 98 and 100 define spiral paths around the shaft from the region of the entrance 94 to the distal end 102 of the channel, which is approximately 180° from the entrance portion. In a preferred form of the invention, a short section of the channel 96 at its distal end 102 is concentric with the shaft 72 so that the last few degrees of rotation of the cam in the region of 180° of rotation, does not draw the cam follower in channel 96 any closer to the shaft, thus providing a small "locking" position for the cam.

As illustrated in FIGS. 1 and 2, when the connector elements 12 and 14 are separated, the cam 70 is placed in its open position, with the semicircular portion of the cam extending outwardly over the forward edge 62 of the housing of connector element 12 so that the entry portion 94 of the camming channel 92 projects forwardly from element 12 in a direction to engage a corresponding cam follower 110 carried on the top surface 40 of the mating socket element 14 of the connector. The cam follower 110 preferably is in the form of an upstanding stub formed unitarily with the top surface 40, but which may be adhesively secured or otherwise fastened to the top wall. The follower 110 has a height and a diameter sufficient to enable it to fit snugly into the camming channel 92 when the elements 12 and 14 are brought together for assembly.

Preferably, the cam body 76 extends sufficiently far out from the front edge 62 of element 12, and the follower 110 is so located on the top surface 40, that the stub enters the entry portion 94 of cam channel 92 during the first, manual stage of assembly of the connector, as the guide rails 48 and 50 enter their corresponding guide channels 22 and 24. The elements 12 and 14 are manually pressed together sufficiently far to initially telescope the element 14 within element 12 and to cause the follower 110 t o move into the entry portion 94 of the cam so that the follower is in contact with wall 98 and is aligned with the camming section 96. This involves a relative motion of element 14 with respect to element 12 of about one-half inch, and brings the terminals 30 into initial contact with sockets 54, completing the first stage of assembly. Thereafter, in the second stage of assembly, rotation of the cam 70 in a clockwise direction, as viewed in FIG. 1, draws the cam follower 110 inwardly toward shaft 72 as the follower moves along the camming surfaces 98 and 100 in camming section 96 of channel 92 Initially, follower 110 is at a distance $R_0$ from shaft 72, but a 180° rotation of cam 70 draws the follower 110 inwardly until it is at a distance $R_1$ from the shaft 72. This, in turn, draws the entire connector element 14 into cavity 26 of element 12 by a distance equal to $R_0$–$R_1$ to thereby pull each of the terminal pins into 30 into full electrical and mechanical contact with its corresponding terminal socket 54. In one form of the invention, the distance $R_0$–$R_1$ may be about one-fourth inch.

It will be noted that a 180° rotation of the cam 70 brings the follower 110 into contact with the end portion 102 of camming channel 96 and aligns the handle 78 with the length of the elongated housing of element 12, but with the locations of handle portions 82 and 83 reversed from the positions illustrated in FIG. 1. The guide channels 22 and 24 and the guide rails 48 and 50 formed on the respective connector elements 12 and 14 insure a smooth assembly of the two elements and maintain proper alignment so that a reliable and rapid interconnection of the terminals and sockets can be obtained.

To disassemble the connector elements, the cam 70 is simply rotated in a counterclockwise direction, as viewed in FIG. 1, forcing the follower 110 to move along channel 96 in the reverse direction and to thereby move from its position at a distance $R_1$ from shaft 72 to a distance $R_0$ from the shaft, thereby separating the terminal pins 30 from the terminal sockets 54. Once the follower 110 reaches the entry region 94, the elements may easily be pulled apart manually. The cam 70 provides the same mechanical advantage for disassembling the connector elements as it provides for their assembly, thereby greatly facilitating the operation of the connector.

Although the present invention has been described in terms of a preferred embodiment, it will be apparent to those of skill in the art that numerous variations and modifications may be made. For example, the cam may be circular instead of semicircular, with a mirror image of the channel 96 continuing around the shaft 72, so that the closing and opening of the connector can be carried out by rotating the cam in either direction. Other variations may also be made without departing from the true spirit and scope thereof, as defined in the following claims.

What is claimed is:

1. A unitary assembly mechanism having a high mechanical advantage for assembling a multiterminal connector, comprising:

a terminal plug connector element including a plug housing of generally rectangular cross-section defining a first cavity enclosing a multiplicity of parallel terminal pins, said housing having at least a first planar wall portion;

a terminal socket connector element including a socket housing of generally rectangular cross-section defining a second cavity enclosing a multiplicity of parallel terminal sockets, and having at least a second planar wall portion, said terminal socket housing being shaped to matingly engage said terminal plug housing with the cavity of one of said plug and socket housings telescopically receiving the other of said housings to interconnect corresponding terminal pins and sockets with said first and second planar wall portions in engagement with each other;

cam means;

shaft means integrally mounting said cam for rotation between open and closed positions on one of said plug and socket connector element planar wall portions, said cam including a generally semicircular body portion having upper and lower parallel, spaced planar surfaces and a peripheral edge wall, the lower planar surface of said cam being adjacent the planar wall portion on which it is mounted and including a lever portion integral with said body portion, said shaft means providing an axis of rotation for said cam means extending generally perpendicular to said, upper and lower cam surfaces and to the planar wall portion on which said cam is mounted;

a cam channel formed in said lower planar surface of said cam body portion, said channel having an entry portion in said peripheral edge wall of said body portion in alignment with said axis of rotation with said entry portion and said axis of rotation defining a connector assembly axis when said cam is in said open position, the assembly axis being perpendicular to and passing through said axis of rotation, said channel further having a distal end locking portion including a channel portion at a constant radius from said axis of rotation and having a curved portion within said body portion extending between said entry and said distal portions and having spaced walls at a radius from said axis of rotation which varies along the length of the channel from a first radius $R_0$ at said entry portion to a second radius $R_1$ at said distal end to define spiral camming surfaces concentric with said axis of rotation;

an upwardly extending cam follower integrally mounted on the other of said plug and socket connector planar wall portions and located to enter said entry portion of said cam channel upon initial assembly of said connector elements along said assembly axis when said cam is in its open position and to engage said spiral camming surfaces, subsequent rotation of said cam body portion through substantially 180° in a first direction about said axis of rotation to its closed position causing said camming surfaces to draw said cam follower into said cam channel toward said distal portion and along said assembly axis a distance equal to $R_0$–$R_1$ to thereby draw said plug and socket connector elements together along said assembly axis into complete mating engagement of said pin and socket terminals for assembly of said connector, entry of said cam follower into said distal end locking portion preventing further rotation of said cam body portion in said first direction from drawing said plug and socket connector elements into closer mating engagement, and rotation of said cam body portion through substantially 180° in a second direction about said axis of rotation causing said camming surfaces to force said follower along said cam channel away from said distal portion and toward said entry portion and along said assembly axis to thereby separate said plug and socket terminal elements and to disengage said pin and socket terminals for disassembly of said connector elements.

2. The assembly mechanism of claim 1, wherein said plug and terminal housings each include forward edges which initially engage each other upon assembly of said connector elements, and wherein said lower planar surface of cam body portion is parallel to said upper planar surface of said corresponding plug or socket housing, and extends over the forward edge of its corresponding housing to engage said follower.

* * * * *